US011808452B2

(12) United States Patent
Pearson et al.

(10) Patent No.: US 11,808,452 B2
(45) Date of Patent: Nov. 7, 2023

(54) INTERMITTENT PILOT IGNITION GAS VALVE HAVING PROTECTION AGAINST NEGATIVE PRESSURE FOR INTERNAL DIAPHRAGMS

(71) Applicants: James E. Pearson, Downers Grove, IL (US); Stephen Sapp, Soddy-Daisy, TN (US); Tony Leeseberg, Elgin, IL (US); Brandon Cole, Chicago, IL (US); Moises Contreras Hernandez, Itasca, IL (US)

(72) Inventors: James E. Pearson, Downers Grove, IL (US); Stephen Sapp, Soddy-Daisy, TN (US); Tony Leeseberg, Elgin, IL (US); Brandon Cole, Chicago, IL (US); Moises Contreras Hernandez, Itasca, IL (US)

(73) Assignee: Robertshaw Controls Company, Itasca, IL (US)

( * ) Notice: Subject to any disclaimer, the term of this patent is extended or adjusted under 35 U.S.C. 154(b) by 406 days.

(21) Appl. No.: 16/932,142

(22) Filed: Jul. 17, 2020

(65) Prior Publication Data

US 2021/0018172 A1 Jan. 21, 2021

Related U.S. Application Data

(60) Provisional application No. 62/875,970, filed on Jul. 19, 2019.

(51) Int. Cl.

| | |
|---|---|
| ***F23N 1/00*** | (2006.01) |
| ***F23N 5/20*** | (2006.01) |
| *F23N 5/24* | (2006.01) |

(52) U.S. Cl.

CPC ..... *F23N 1/00* (2013.01); *F23N 5/20* (2013.01); *F23K 2900/05001* (2013.01);

(Continued)

(58) Field of Classification Search

CPC . F23K 2900/05001; F23K 2900/05002; F23N 1/00; F23N 5/20; F23N 5/242;

(Continued)

(56) References Cited

U.S. PATENT DOCUMENTS 3,704,854 A * 12/1972 Katchka ..... F23N 1/007 251/333
4,044,794 A * 8/1977 Matthews ..... F23N 1/007 137/66

(Continued)

FOREIGN PATENT DOCUMENTS

JP 11-014164 A 1/1999
JP 2015-533396 A 11/2015

(Continued)

*Primary Examiner* — Steven B McAllister
*Assistant Examiner* — Benjamin W Johnson
(74) *Attorney, Agent, or Firm* — Reinhart Boerner Van Deuren P.C.

(57) ABSTRACT

Provided are embodiments of a gas valve for an intermittent pilot ignition system. The gas valve includes features designed to address the buildup of negative pressure in a fuel line connected to the gas valve that could cause internal valve diaphragms to open, drawing fuel from the gas valve. In embodiments, the gas valve includes a system of check valves designed to seal off the gas valve when a negative pressure develops. In other embodiments, the gas valve includes a relief valve having a relief port so that air is able to enter the valve proximate to the inlet port so as to avoid building a negative pressure sufficient to open the diaphragms. In both cases, the valve remains primed with fuel for subsequent ignition. The gas valve is envisioned to be useful for a variety of pilot operated systems.

16 Claims, 10 Drawing Sheets

(52) U.S. Cl.
CPC .... *F23K 2900/05002* (2013.01); *F23N 5/242* (2013.01); *F23N 2227/24* (2020.01); *F23N 2227/30* (2020.01); *F23N 2227/32* (2020.01); *F23N 2235/14* (2020.01); *F23N 2235/18* (2020.01); *F23N 2235/20* (2020.01)

(58) Field of Classification Search
CPC ..... F23N 2227/24; F23N 2227/30; F23N 2227/32; F23N 2235/14; F23N 2235/18; F23N 2235/20
USPC ..... 431/73
See application file for complete search history.

(56) References Cited

U.S. PATENT DOCUMENTS 4,413,975 A * 11/1983 Turner ..... F23Q 9/10 431/82
5,950,924 A 9/1999 Hatakeyama et al.

FOREIGN PATENT DOCUMENTS

KR 10-1067006 B1 9/2011
WO WO 2013-055669 A1 4/2013

* cited by examiner

INTERMITTENT PILOT IGNITION GAS VALVE HAVING PROTECTION AGAINST NEGATIVE PRESSURE FOR INTERNAL DIAPHRAGMS

CROSS-REFERENCE TO RELATED PATENT APPLICATIONS

This patent application claims the benefit of U.S. Provisional Patent Application No. 62/875,970, filed Jul. 19, 2019, the entire teachings and disclosure of which are incorporated herein by reference thereto.

FIELD OF THE INVENTION

This invention generally relates to a valve, and more particularly, this invention relates to an intermittent pilot ignition valve designed to reduce negative pressure in a fuel line.

BACKGROUND OF THE INVENTION

In applications involving a pilot light, intermittent ignition systems are becoming increasingly popular because of the efficiencies associated with igniting a pilot light only when needed as opposed to traditional standing pilot lights that can remain lit for extended periods of time. However, in certain circumstances, a negative pressure may build up in the fuel line of an intermittent pilot ignition system during extended periods of nonuse (e.g., during a long vacation). The cause of the negative pressure on the fuel line during periods of nonuse is not currently known, but this negative pressure can pull air into the fuel line from the outlet and pilot ports, displacing the fuel in the valve and fuel line. Thereafter, attempts to ignite the pilot light with a spark fail because the spark will only be exposed to the air in the fuel line until fuel flow can push all the air out of the fuel line and through the valve. However, control circuitry for generating the spark is designed to lockout after a certain number of unsuccessful attempts because of the possibility of fuel building up in the surrounding space. Such a lockout typically requires a service call in order to reset the system, which is an undesirable situation for customers.

Accordingly, a need exists in the art for a valve that prevents fuel from being evacuated from the valve during periods of inactivity. Embodiments disclosed herein provide such a valve. These and other advantages of the invention, as well as additional inventive features, will be apparent from the description of the invention provided herein.

BRIEF SUMMARY OF THE INVENTION

Provided herein are various embodiments of a gas valve for an intermittent pilot ignition system. The gas valve includes features designed to prevent the buildup of negative pressure in a fuel line connected to the gas valve that could cause internal valve members to open, drawing fuel from the gas valve. In an embodiment, the gas valve includes a system of check valves designed to seal off the gas valve when a negative pressure develops. In other embodiments, the gas valve includes a relief valve having a relief port so that air only enters the valve proximate to the inlet port while the remainder of the valve remains primed with fuel for subsequent ignition. The gas valve is envisioned to be useful for a variety of pilot operated systems, including fireplaces, cooking appliances, furnaces, boilers, hot water heaters, etc.

According to a first aspect, embodiments of a gas valve for an intermittent pilot ignition system. The gas valve includes a valve housing having a first fluid pathway between an upstream inlet port and a downstream outlet port and a second fluid pathway between the upstream inlet port and a downstream pilot port. A first diaphragm is disposed in the first fluid pathway between the upstream inlet port and the downstream outlet port, and a second diaphragm is disposed in the first fluid pathway between the upstream inlet port and the downstream outlet port. Further, at least one valve is disposed in the first fluid pathway or the second fluid pathway. The at least one valve is configured to prevent the first diaphragm and the second diaphragm from opening under a negative pressure having an absolute value of at least 26" W.C.

In such embodiments, the at least one valve includes two check valves disposed in the second fluid pathway. Further, in certain examples of such embodiments, a first check valve of the two check valves is positioned in a first flow passage between a first side of the first diaphragm and a second side of the first diaphragm, and a second check valve of the two check valves is positioned in a second flow passage downstream of the first flow passage and proximal to the pilot port. Further, in particular embodiments, the first check valve and the second check valve are both ball valves.

In other such embodiments, the at least one valve includes a relief valve disposed in the first fluid pathway. In certain examples of such embodiments, the valve housing further includes an inlet chamber disposed between the upstream inlet port and the first diaphragm. In particular embodiments, the relief valve includes a relief port providing a passage from the inlet chamber to an exterior of the valve housing and a spring-biased plunger disposed within a bore of the valve housing. The spring-biased plunger has a stopper head coaxial with the relief port. During periods of fuel gas flow, a positive fuel gas pressure within the inlet chamber forces the stopper head against the relief port to block flow through the relief port. During periods of inactivity, the negative pressure causes the spring-biased plunger to retract the stopper head from the relief port.

In embodiments of the gas valve, the first diaphragm and the second diaphragm are prevented from opening under the negative pressure having an absolute value of at least 55" W.C.

In another aspect, embodiments of the disclosure relate to a gas valve for an intermittent pilot ignition system. The gas valve includes a valve housing having a first fluid pathway between an upstream inlet port and a downstream outlet port and a second fluid pathway between the upstream inlet port and a downstream pilot port. A first diaphragm is disposed in the first fluid pathway between the upstream inlet port and the downstream outlet port, and a second diaphragm is disposed in the first fluid pathway between the upstream inlet port and the downstream outlet port. A first check valve is disposed in the second fluid pathway, and the first check valve is positioned in a first flow passage between a first side of the first diaphragm and a second side of the first diaphragm. A second check valve is disposed in the second fluid pathway, and the second check valve is positioned in a second flow passage downstream of the first flow passage and proximal to the pilot port. The first check valve and the second check valve are configured to prevent the first diaphragm and the second diaphragm from opening under a negative pressure having an absolute value of at least 26" W.C.

In embodiments, the first diaphragm and the second diaphragm are prevented from opening under a negative pressure having an absolute value of at least 55" W.C.

In embodiments, the first check valve is a ball valve.

In embodiments, the second check valve is a ball valve.

In embodiments, a solenoid is disposed between the first flow passage and the second flow passage, and the solenoid is configured to control a flow of gas between the first flow passage and the second flow passage.

In embodiments, the first flow passage includes a bleed valve between the first side of the first diaphragm and the second side of the first diaphragm. In certain examples of such embodiments, the bleed valve is downstream of the first check valve.

In embodiments, the first diaphragm is upstream of the second diaphragm.

According to another aspect, embodiments of the disclosure relate to a gas valve for an intermittent pilot ignition system. The gas valve includes a valve housing including a fluid pathway between an inlet port and an outlet port. The fluid pathway include a first diaphragm and a second diaphragm between the inlet port and the outlet port. An inlet chamber is contained within the valve housing and is disposed between the inlet port and the first diaphragm. The gas valve also includes a relief valve including a relief port providing a passage from the inlet chamber to an exterior of the valve housing and a plunger disposed within a bore of the valve housing. The plunger has a stopper head coaxial with the relief port. During periods of fuel gas flow, a positive fuel gas pressure within the inlet chamber forces the stopper head against the relief port to block flow through the relief port. During periods of inactivity, a negative pressure at the inlet port causes the plunger to retract the stopper head from the relief port at a first pressure having an absolute value lower than an absolute value of a second pressure required to open the first diaphragm or the second diaphragm.

In embodiments, the absolute value of the second pressure is at least 26" W.C. In further embodiments, the absolute value of the second pressure is at least 55" W.C.

In embodiments, the plunger is biased towards the relief port using a spring.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

As will be described below an in relation to the drawings, various embodiments of a gas valve for an intermittent pilot ignition system are provided herein. The gas valve includes at least one check or relief valve designed to prevent opening of internal diaphragms of the valve under negative pressure in a fuel line connected to the valve during periods of inactivity. In this way, the valve remains filled or primed with at least some gas so that, during periods of activity, the gas can be more easily ignited prior to engagement of safety lockout features in the valve controller. In embodiments, the gas valve includes a system of check valves designed to seal off the gas valve when a negative pressure develops during periods of inactivity. In other embodiments, the gas valve includes a relief valve having a relief port so that negative pressure in the valve cannot build up to a degree sufficient to open the internal diaphragms. The gas valve is envisioned to be useful for a variety of pilot operated systems, including fireplaces, cooking appliances, furnaces, boilers, and hot water heaters, among others. The embodiments described herein and shown in the figures are exemplary in nature and should not be construed as limiting.

Figure 1:
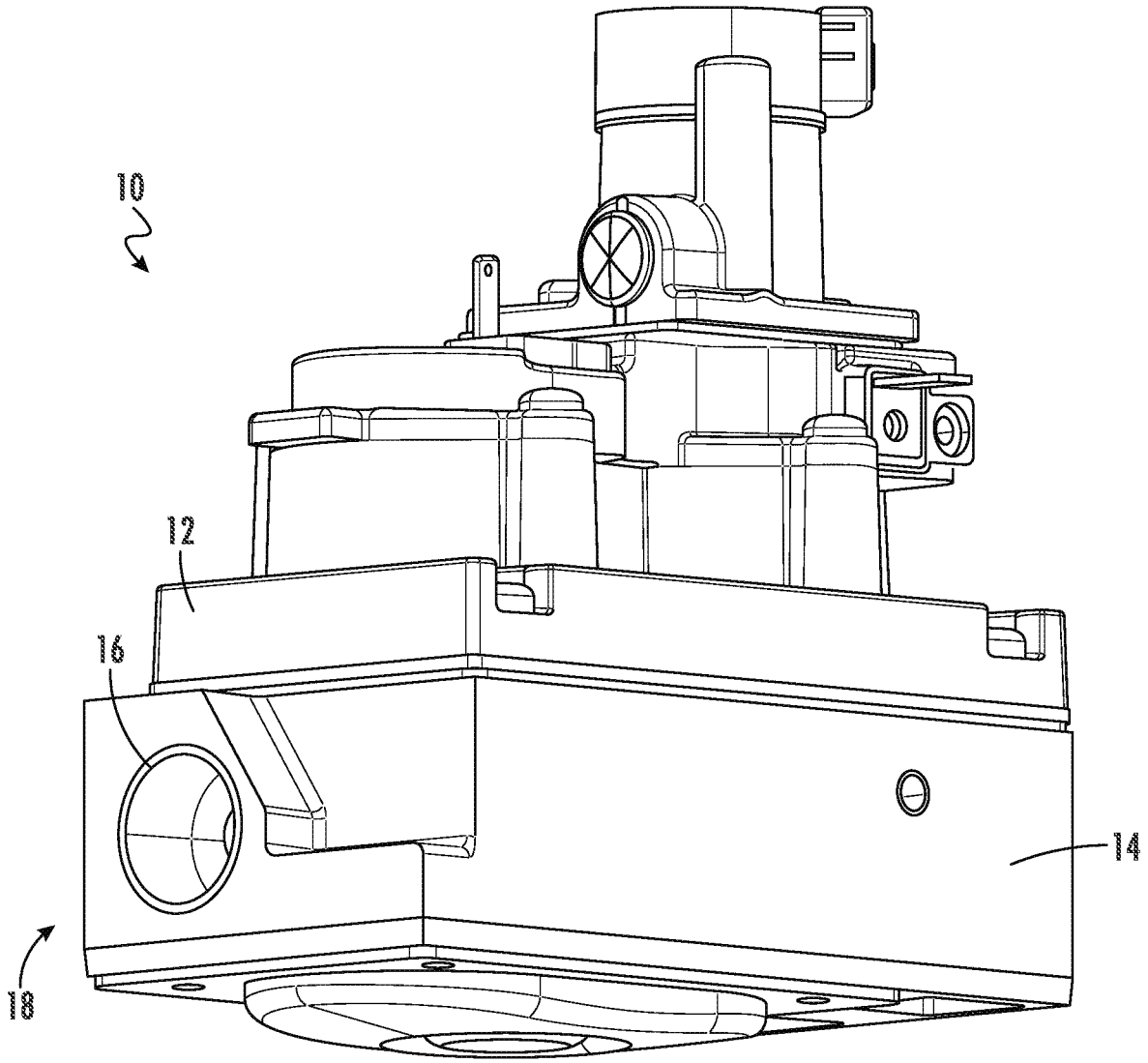
FIG. 1 depicts perspective view of a gas valve for an intermittent pilot ignition system, according to an exemplary embodiment.
Figure 2:
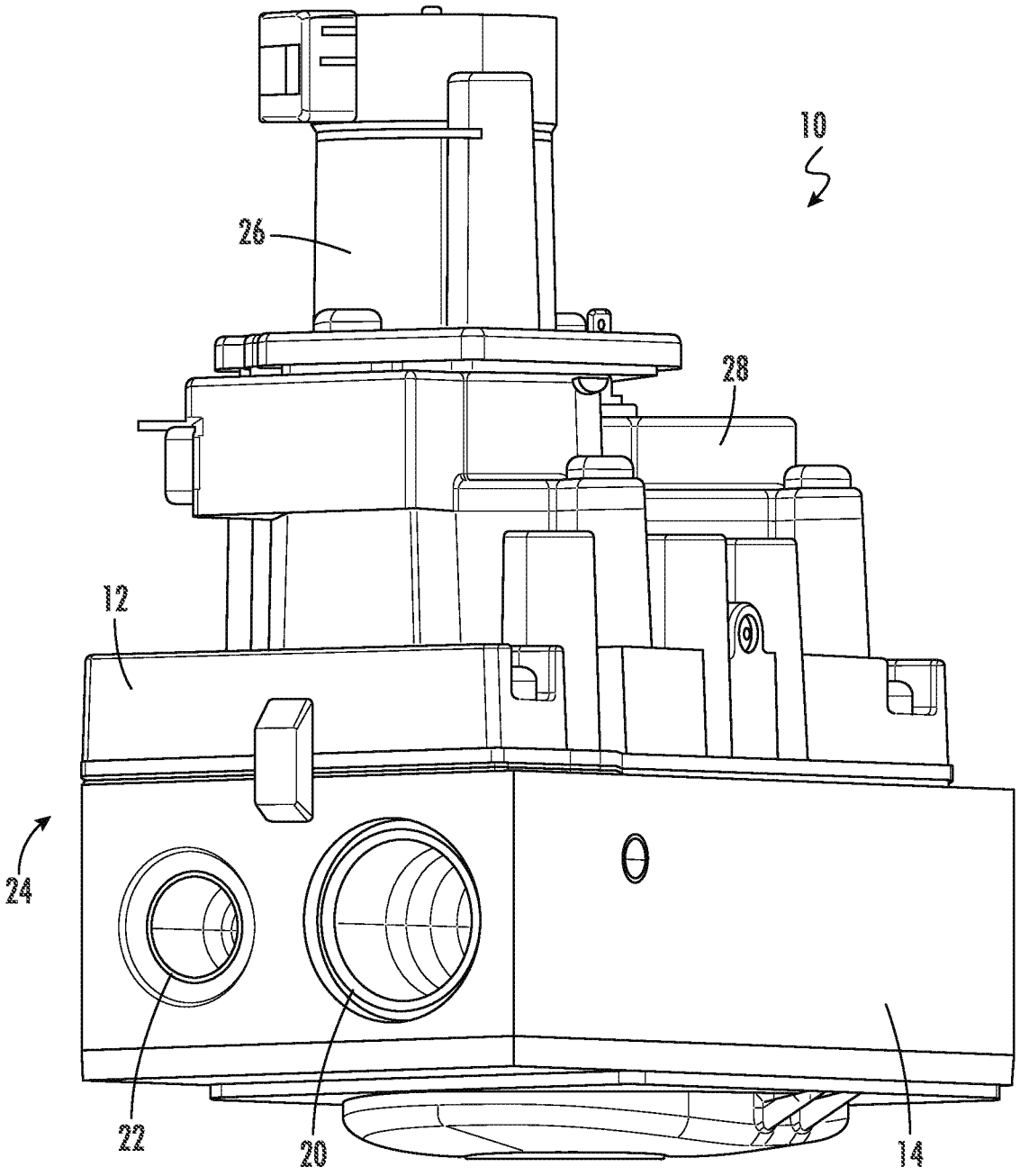
FIG. 2 depicts another perspective view of the gas valve of FIG. 1, according to an exemplary embodiment.

With reference to FIG. 1, an embodiment of a gas valve 10 for an intermittent pilot ignition system is depicted. The gas valve 10 includes an upper valve housing 12 and a lower valve housing 14. As can be seen in FIG. 1, the lower valve housing 14 includes an inlet port 16 on a first end 18 of the lower valve housing 14. As shown in FIG. 2, the lower valve housing 14 includes an outlet port 20 and a pilot port 22 on a second end 24 of the lower valve housing 14. Flow from the inlet port 16 (of FIG. 1) to the outlet port 20 is controlled by a first solenoid 26 mounted on the upper valve housing 12, and flow from the inlet port 16 (of FIG. 1) to the pilot port 22 is controlled by a second solenoid 28 mounted on the upper valve housing 12. As mentioned above, in an intermittent pilot ignition system, the pilot flame is ignited when the system is in use, and during periods of inactivity, there is no standing flame. Thus, the second solenoid 28 controls when pilot fuel is able flow through the pilot port 22 for ignition.

Figure 3:
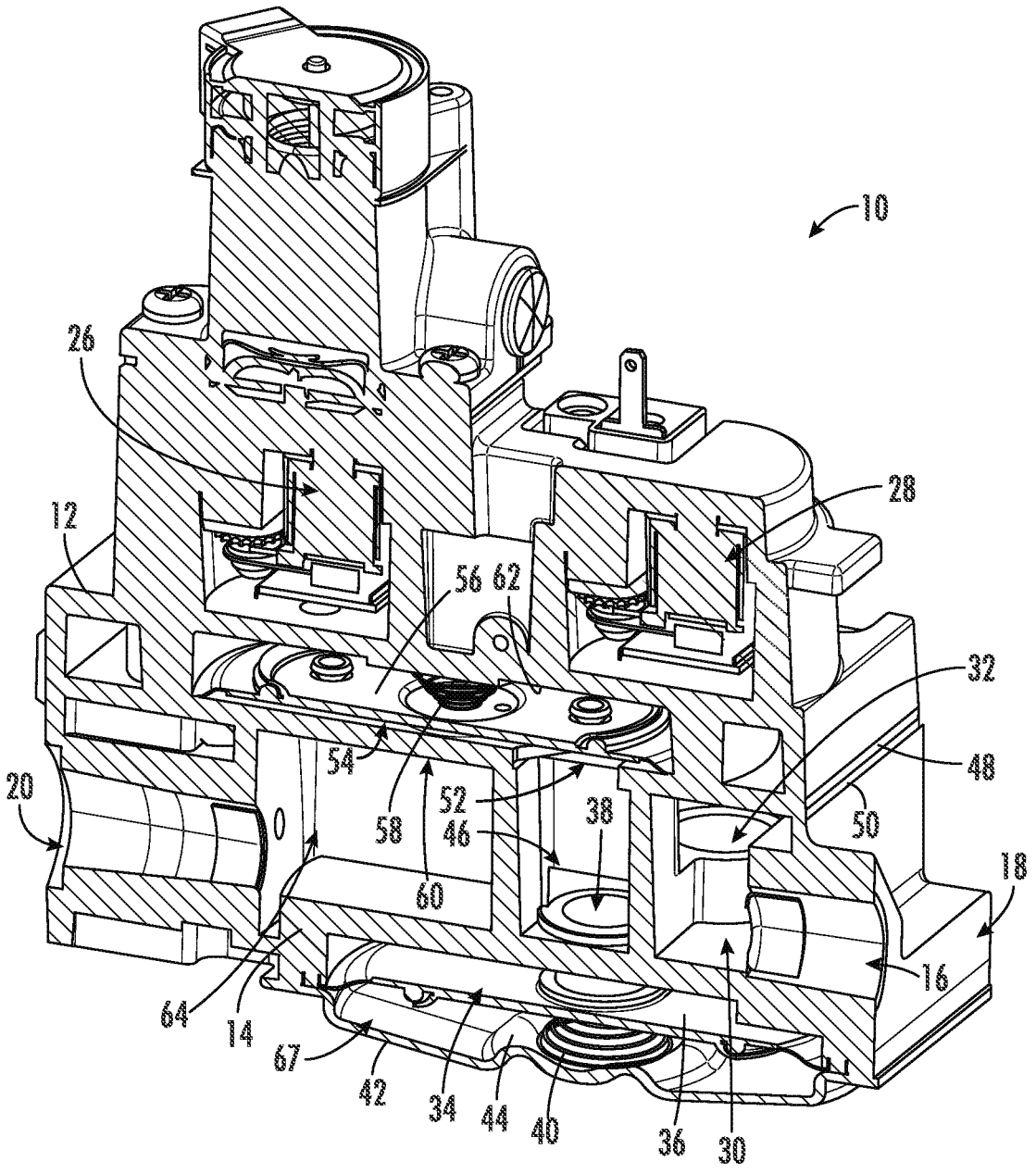
FIG. 3 depicts a cross section of the gas valve of FIG. 1, according to an exemplary embodiment.

FIG. 3 depicts a cross-sectional view of the gas valve 10. Fuel gas (e.g., natural gas or LP gas) flows through the inlet port 16 into an inlet chamber 30 that includes a first passage 32 leading into a first diaphragm chamber 34. The first diaphragm chamber 34 is defined in part by a first diaphragm 36. The first diaphragm 36 controls flow through a second passage 38. In the embodiment shown in FIG. 3, the first diaphragm 36 is biased in a closed position, such that flow through the second passage 38 is blocked unless fluid pressure within the diaphragm chamber 34 is sufficient to overcome the biasing force of the first diaphragm 36. As shown in FIG. 3, the diaphragm 36 is biased closed with a first spring 40 positioned between a surface of the diaphragm 36 and a biasing plate 42. The biasing plate 42 includes a raised ring 44 to hold the spring 40 (which is depicted as a conical spring) in place. The basing plate 42 is secured (welded, fastened, adhered, etc.) to the underside of the lower valve housing 14. When fluid pressure is sufficient to overcome the biasing force of the diaphragm 36, the fuel gas flows through second passage 38 into an interior chamber 46.

Disposed between the upper valve housing 12 and the lower valve housing 14 are a valve plate 48 and a gasket 50. The gasket 50 is disposed between the valve plate 48 and the lower valve housing 14, and when the upper valve housing 12 is secured to the lower valve housing 14 and valve plate 48, the gasket 50 prevents unintended fluid flow between chambers of the lower valve housing 14. As shown in FIG. 3, the gasket 50 and valve plate 48 include an aperture 52 through which fluid from the interior chamber 46 can flow into a second diaphragm chamber 54.

The second diaphragm chamber 54 is defined in part by a second diaphragm 56. The second diaphragm 56 is biased in a closed position via a second spring 58 to prevent fluid flow through a third passage 60. When fluid pressure is sufficient to overcome the biasing force of the second spring 58, the second diaphragm 56 unblocks the third passage 60 so that fluid can flow through the third passage 60. As shown in FIG. 3, the second spring 58 is a conical spring having the tip of the second spring 58 in contact with the second diaphragm 56 and a base of the second spring 58 in contact with an interior wall 62 of the upper valve housing 12. When fluid pressure is sufficient to overcome the biasing force against the second diaphragm 56, the fuel gas flows through third passage 60 into an outlet chamber 64. In embodiments, the first solenoid 26 is used to manipulate the fluid pressure, e.g., by balancing fuel gas on pressure on either side of the diaphragms 36, 56 as is known in the art. The outlet chamber 64 is in fluid communication with outlet port 20, and thus, the fuel gas is able to flow through the gas valve 10 by flowing past two diaphragms 36, 56.

In embodiments, fuel gas flow to the pilot port 22 is controlled by the second solenoid 28. As discussed above, fuel gas flows into the first diaphragm chamber 34 without obstruction. As shown in the cross-section of the gas valve 10 in FIG. 4, a first pilot passage 66 is in fluid communication with a biasing plate chamber 67 formed by the first diaphragm 36 and the biasing plate 42. A bleed valve 68 is disposed in the first pilot passage 66 in the first diaphragm chamber 34. A second pilot passage 69 provides fluid communication between the biasing plate chamber 67 and a first pilot chamber 70 within the lower valve housing 14. FIG. 5 shows a cross-section of the gas valve 10 taken perpendicular to the plane of the cross section of FIG. 4. The plane runs through the first pilot chamber 70. As can be seen in FIG. 5, the first pilot chamber 70 is in fluid communication with a third pilot passage 71 that leads into a solenoid chamber 72 of the second solenoid 28.

Figure 4:
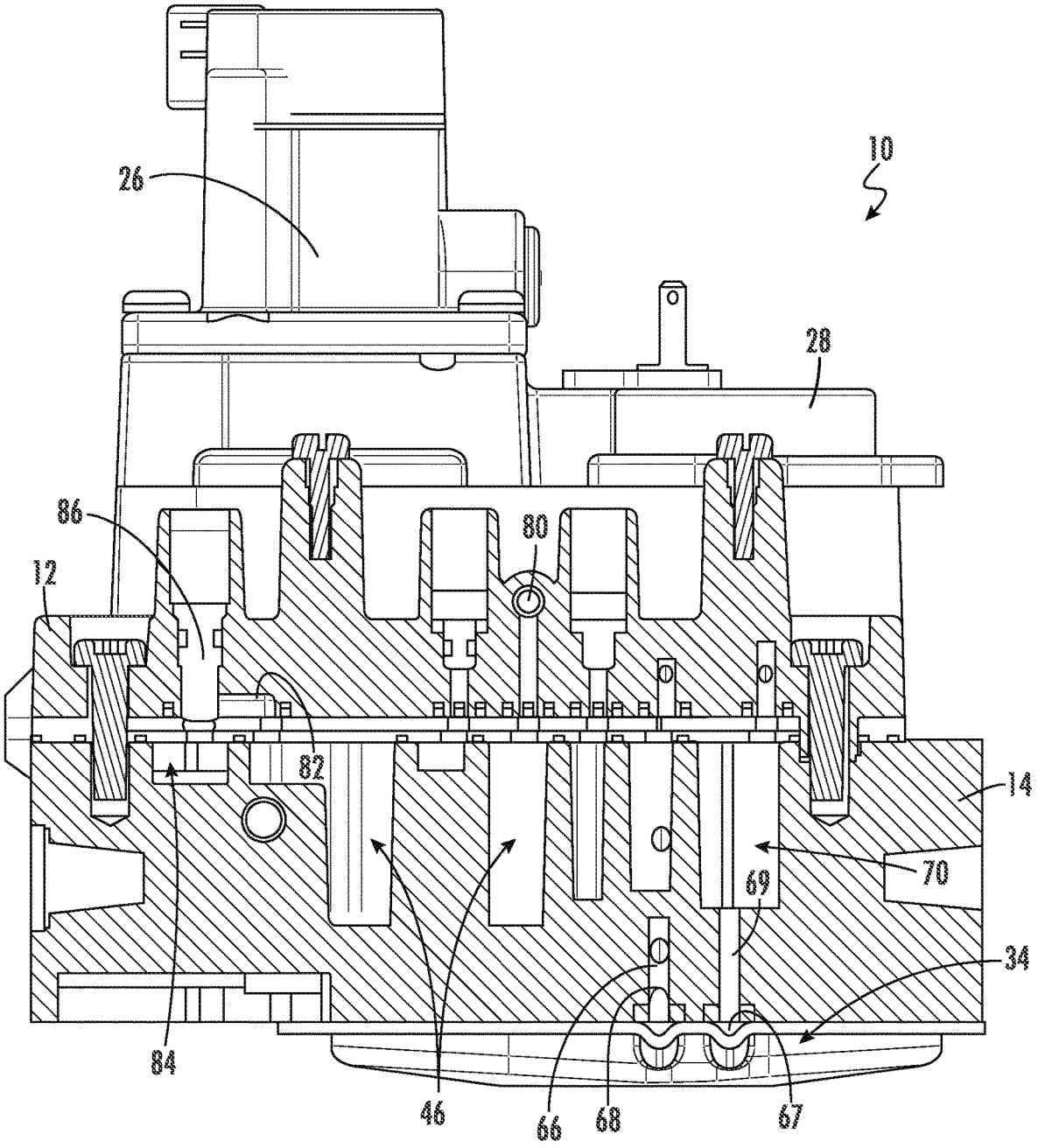
FIG. 4 depicts another cross section of the gas valve of FIG. 1, according to an exemplary embodiment.
Figure 5:
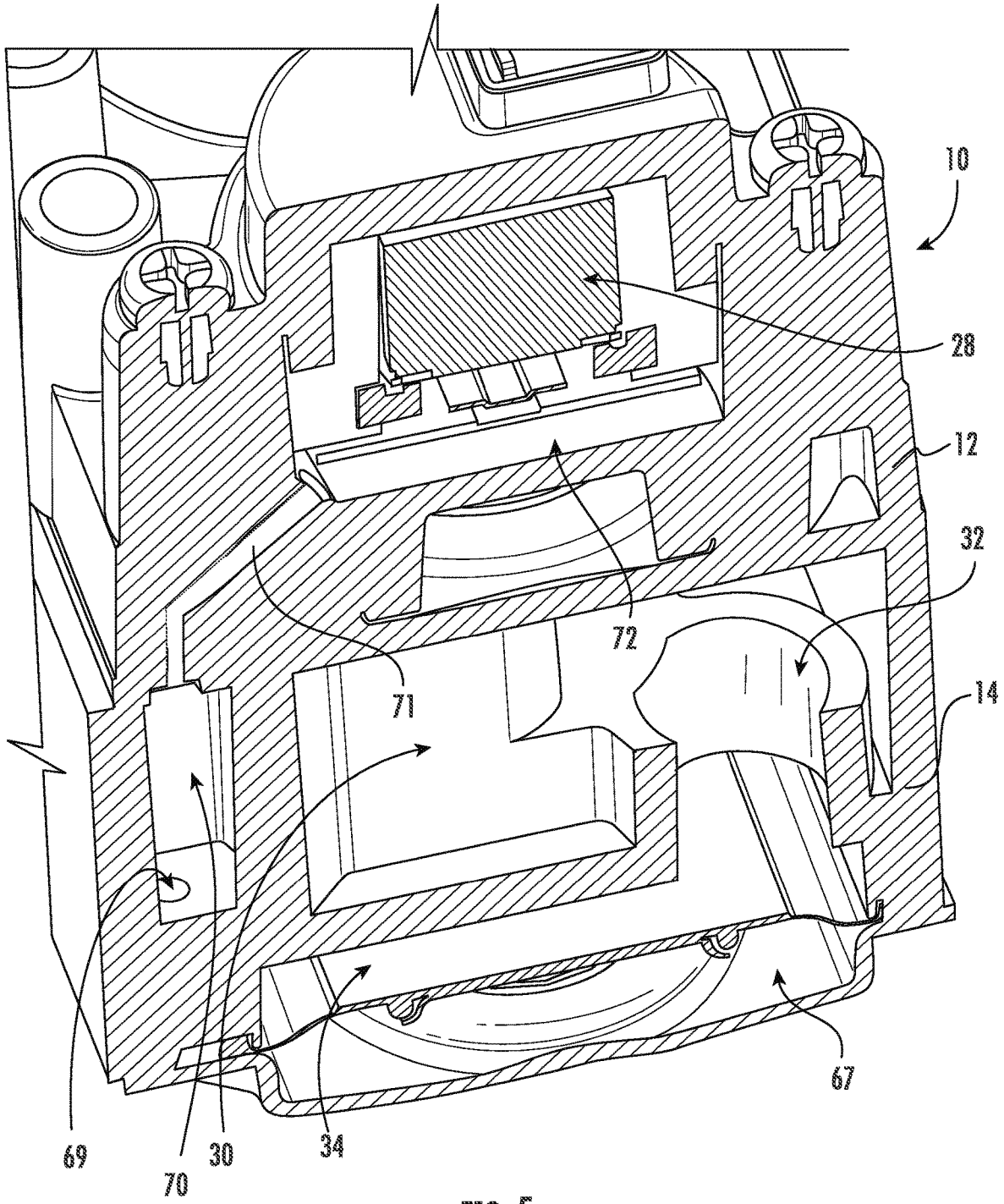
FIG. 5 depicts still another cross section of the gas valve of FIG. 1, according to an exemplary embodiment.
Figure 6:
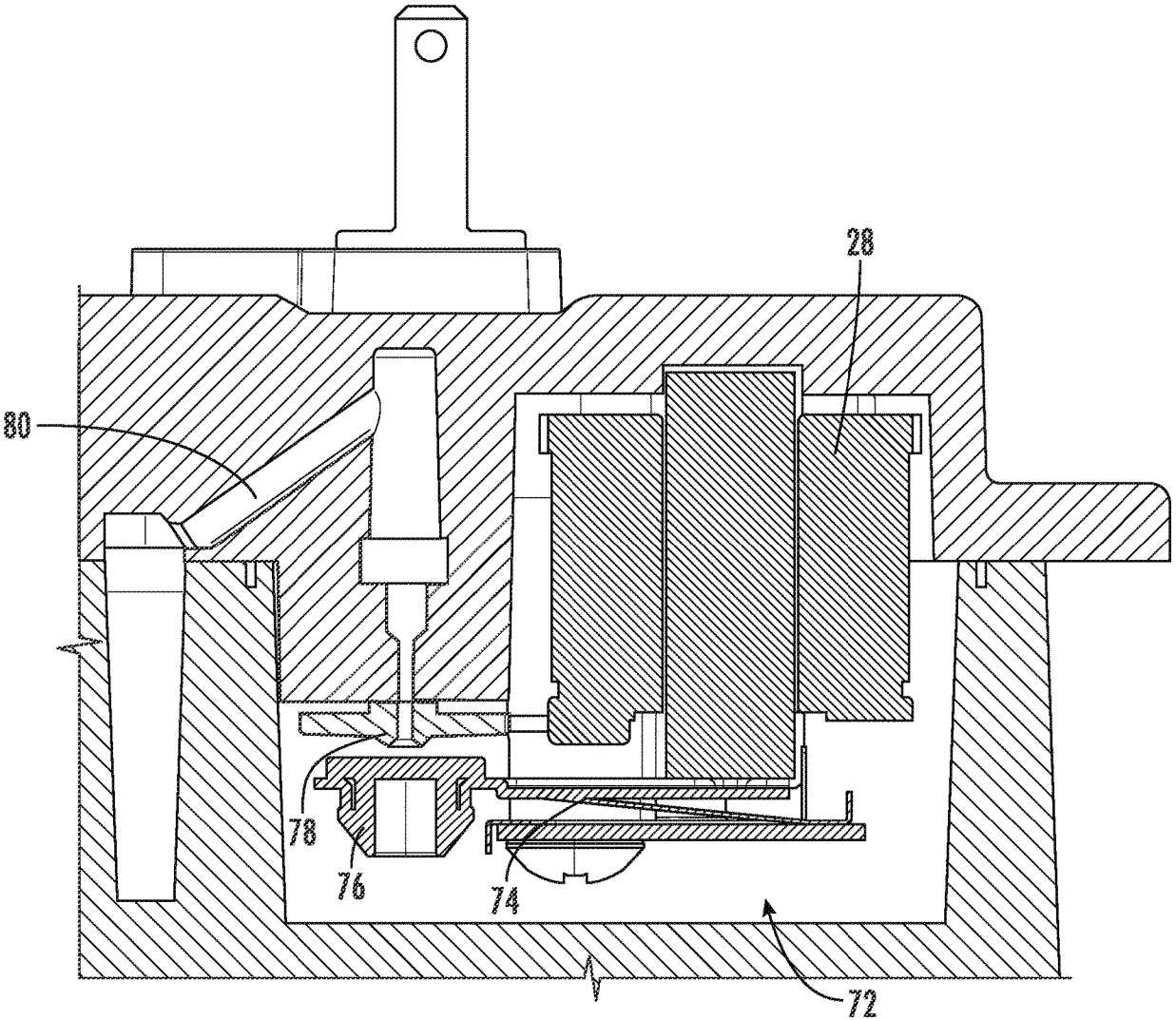
FIG. 6 depicts a cross section of a solenoid chamber of the gas valve of FIG. 1, according to an exemplary embodiment.

FIG. 6 depicts a cross-section of the second solenoid 28 taken along a plane running through the solenoid chamber 72 that is perpendicular to the plane of the cross section shown in FIG. 5 and parallel to and spatially disposed from the plane of the cross section shown in FIG. 4. As can be seen in FIG. 6, the second solenoid 28 actuates a lever 74 having a stopper 76 at an end thereof. The stopper 76 is configured to engage a seat 78 at the entrance of a fourth pilot passage 80. When the second solenoid 28 is energized (or de-energized as the case may be), the end of the lever 74 opposite the stopper 76 is forced downward, causing the stopper 76 to move upward against the seat 78 and blocking fuel gas flow to the fourth pilot passage 80. Returning to FIG. 4, the fourth pilot passage 80 flows into the interior chamber 46. Thus, the fuel gas going to the pilot port 22 bypasses the first diaphragm 36 through the pilot passages 66, 69, 71, 80, biasing plate chamber 67, first pilot chamber 70, and solenoid chamber 72 based on the actuation state of the second solenoid 28.

Figure 7:
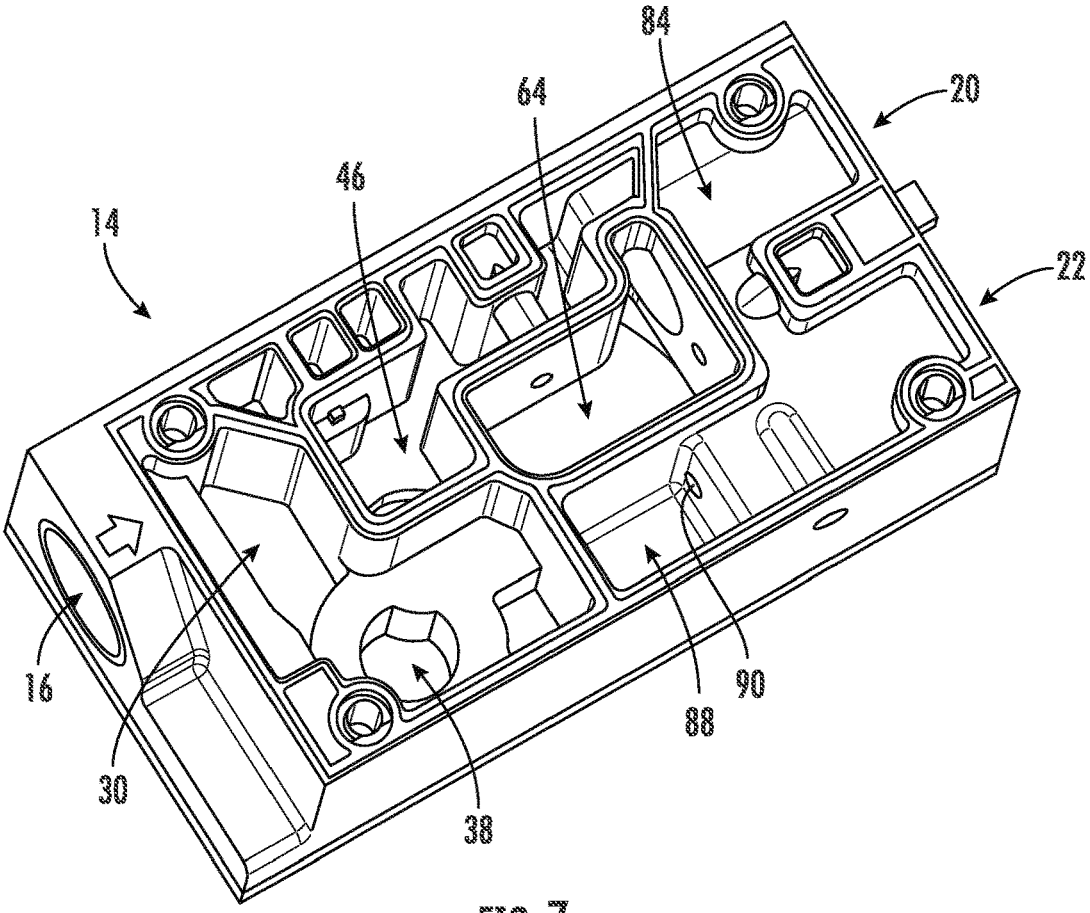
FIG. 7 depicts a lower valve housing of the gas valve of FIG. 1, according to an exemplary embodiment.

As can also be seen in FIG. 4, the fuel gas flow from the interior chamber 46 through a fifth pilot passage 82 into a second pilot chamber 84. In embodiments, the fifth pilot passage 82 is or can be at least partially obstructed by a pilot metering device 86 (e.g., a bolt or screw) that can be pushed into or backed out of the fifth pilot passage 82 to restrict or increase fuel gas flow. As shown in FIG. 7, the second pilot chamber 84 extends over the outlet port 20 and over the pilot port 22 along the second end 24 of the lower valve housing 14. The fuel gas flows back towards the first end 18 and down into a depression 88. A sixth pilot passage 90 is in fluid communication with the depression 88 and with the pilot port 22.

Figure 8:
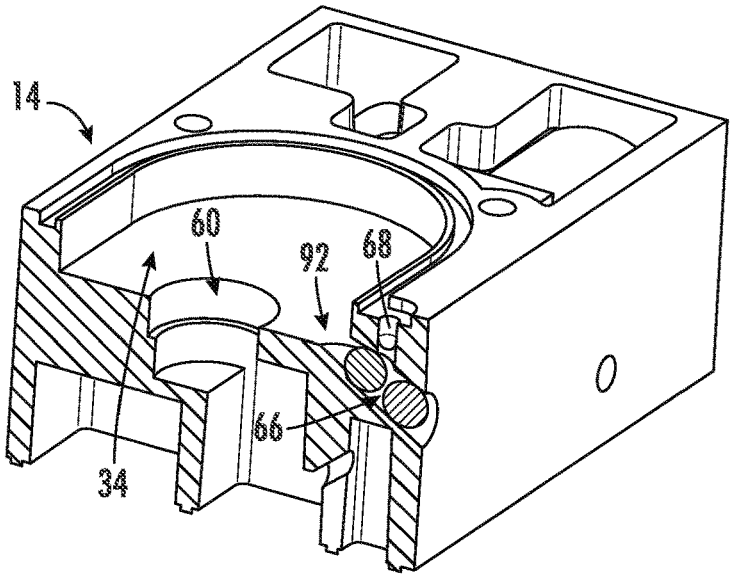
FIG. 8 depicts a cross section of the lower valve housing of FIG. 8 showing a first check valve, according to an exemplary embodiment.
Figure 9:
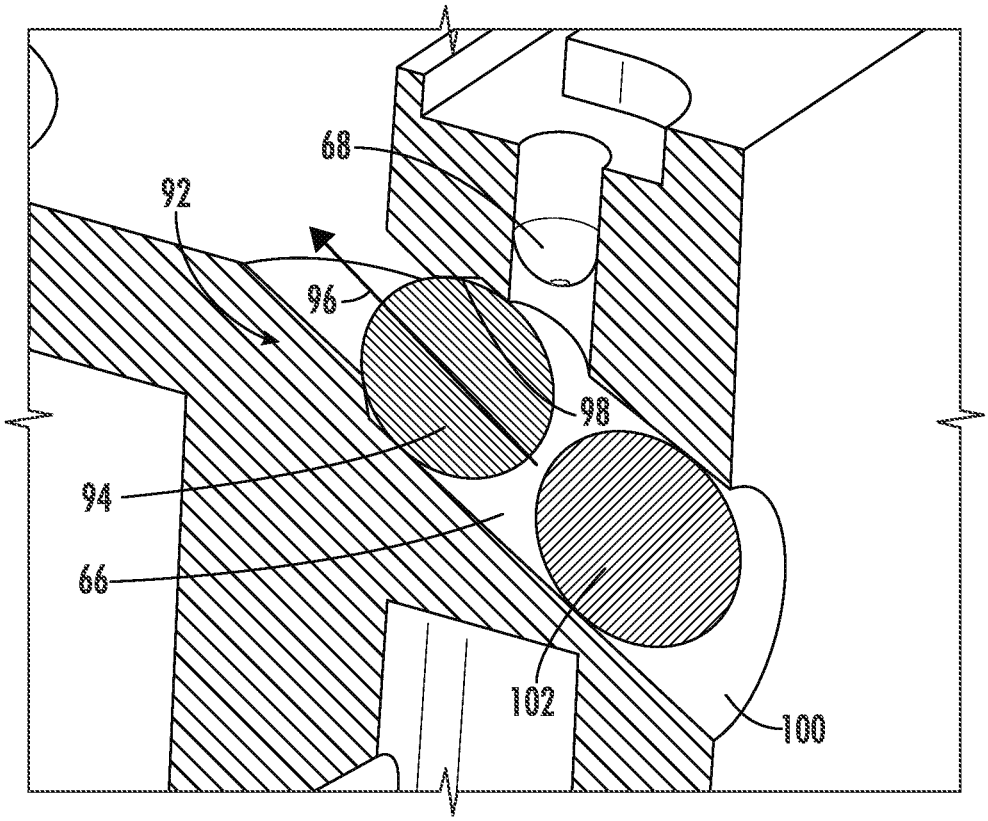
FIG. 9 depicts a close-up view of the first check valve of FIG. 8, according to an exemplary embodiment.

Having generally described the flow of fuel gas through the gas valve 10, the features configured to reduce the buildup of negative pressure in the fuel line and to remove air will now be described. FIG. 8 depicts a first check valve 92 of a check valve system configured to withstand a negative pressure of up to 26" W.C. in embodiments, and up to 55" W.C. in further embodiments. The first check valve 92 is positioned on the first pilot passage 66 in fluid communication with the first diaphragm chamber 34. As discussed above, the first diaphragm chamber 34 is in direct fluid communication with in the inlet port 16. Thus, a negative pressure at the inlet port 16 will draw from the first pilot passage 66. As shown in the close-up view of the check valve 92 in FIG. 9, a first ball 94 is provided in the first pilot passage 66 such that, when a negative pressure is applied as denoted by arrow 96, the ball 94 is pulled against a first seating surface 98 to block off flow through the first pilot passage 66. In an embodiment, the first ball 94 is installed in the first pilot passage 66 by drilling a hole 100 from the exterior of the lower valve housing 14 that intersects with the first pilot passage 66. The first ball 94 is inserted, and then the hole 100 is sealed with a sealing member 102 (e.g., a ball welded into the hole 100).

Figure 10:
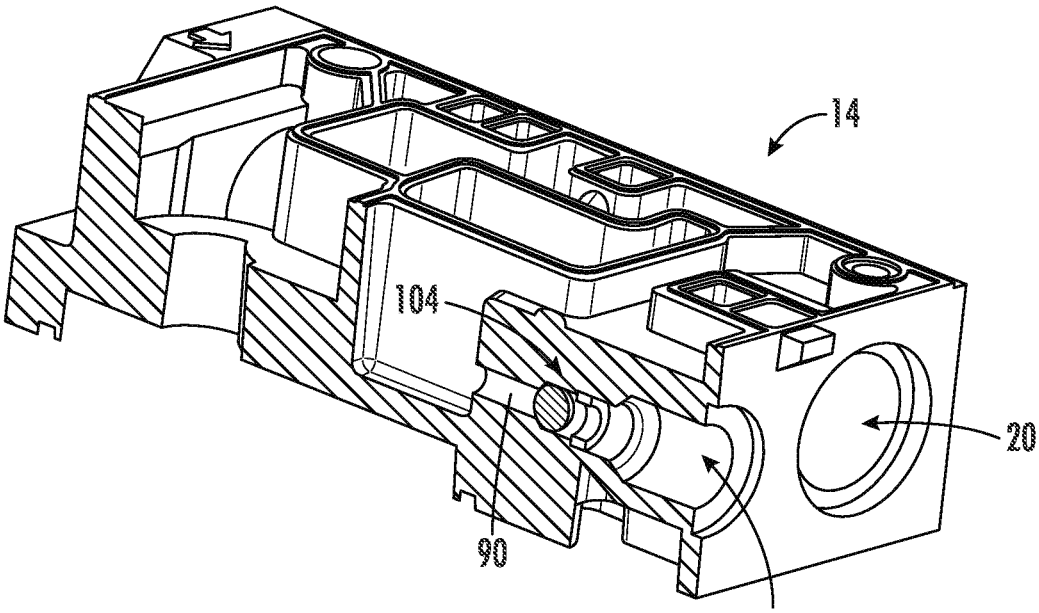
FIG. 10 depicts a cross section of the lower valve housing of FIG. 8 showing a second check valve, according to an exemplary embodiment.
Figure 11:
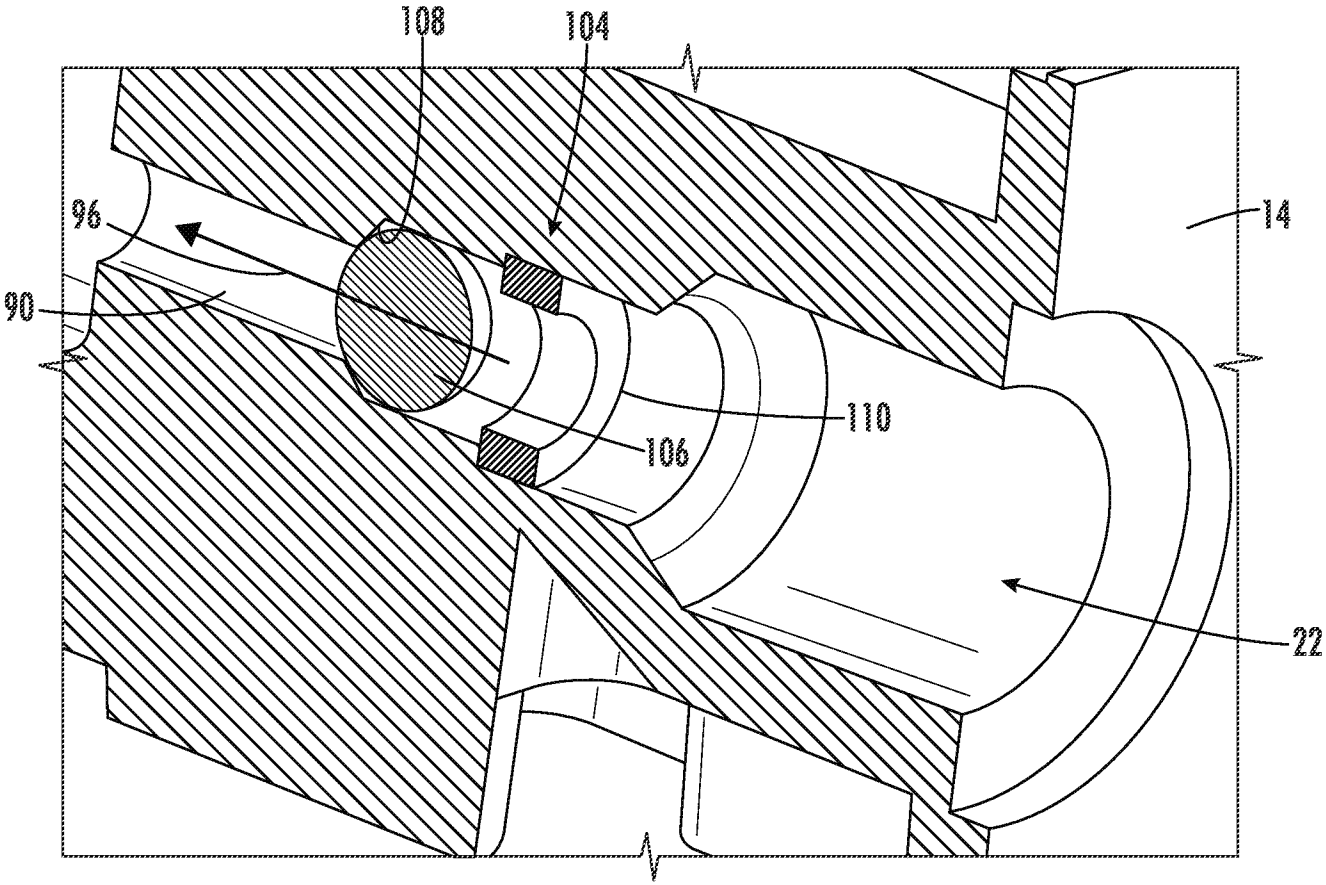
FIG. 11 depicts a close-up view of the second check valve of FIG. 10, according to an exemplary embodiment.

As shown in FIG. 10, the check valve system includes a second check valve 104 located in the sixth pilot passage 90 immediately upstream of the pilot port 22. As can be seen in the close-up view of FIG. 11, a second ball 106 is provided in the sixth pilot passage 90. When a negative pressure (arrow 96) from the inlet port 16 is applied, the second ball 106 is pulled against a second seating surface 108 to block off flow from the pilot port 22. In order to retain the second ball 106 in the sixth pilot passage 90, a retaining washer 110 is provided in the sixth pilot passage 90 between the second ball 106 and the pilot port 22. The retaining washer 110 is shaped such that the second ball 106 does not form a seal when abutting the retaining washer 110. The combination of the first check valve 92 and the second check valve 104 seal off the internal passages and chambers to eliminate negative pressure across the diaphragms 36, 56.

Figure 12:
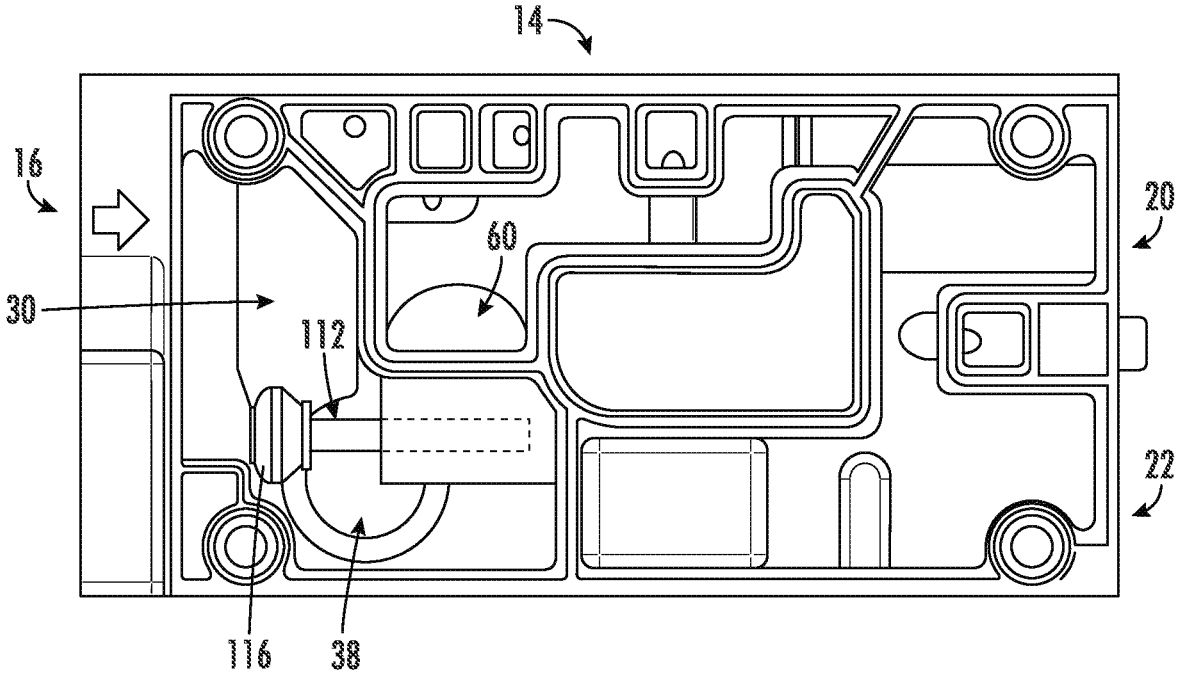
FIG. 12 depicts another embodiment of a lower valve housing having a relief valve, according to an exemplary embodiment.
Figure 13:
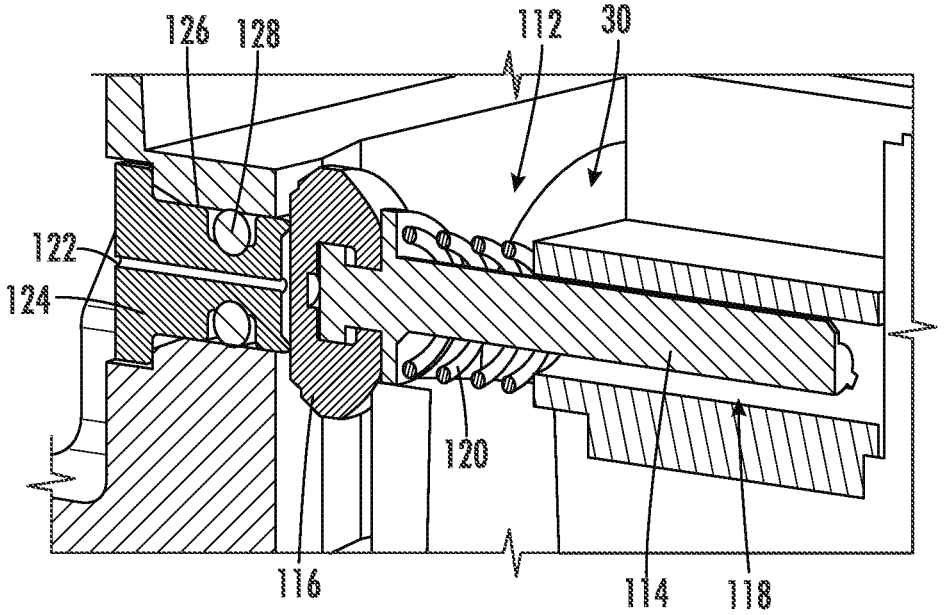
FIG. 13 depicts a partial cross sectional view of the relief valve of FIG. 12, according to an exemplary embodiment.

FIG. 12 depicts another embodiment of the lower valve housing 14 including a relief valve 112. As can be seen in FIG. 12, the relief valve 112 is contained in the inlet chamber 30. As shown in the partial cross sectional view of FIG. 13, the relief valve 112 includes a plunger 114 having a stopper head 116. The plunger 114 is inserted in a bore 118 and is surrounded (at least partially) by a spring 120. The plunger 114 and bore 118 are coaxial with a relief port 122. In embodiments, the relief port 122 is part of a fitting 124 that is inserted in a through hole 126 formed in the first end 18 of the gas valve 10. As can be seen, the fitting 124 is sealed in the through hole 126 with a gasket 128. The spring 120 biases the stopper head 116 against the relief port 122 such that air is not drawn into the inlet chamber 30 during normal operation of the valve.

However, during periods of inactivity when a negative pressure may develop at the inlet port 16, the negative pressure causes the plunger 114 to compress the spring 120, moving the stopper head 116 away from the relief port 122. In this way, air is drawn into the inlet chamber 30 locally in the region of the inlet 16. However, the spring force of the spring 120 is selected such that the spring 120 compresses prior to the diaphragms 36, 56 opening. In this way, the gas valve 10 remains primed with fuel gas even though the inlet chamber 30 may contain air. The fuel gas 30 remaining in the gas valve 10 will allow the pilot light to ignite before the controller locks out. In this way, even though negative pressure develops and the fuel supply line may contain air, the intermittent pilot ignition system will still be able to operate within its programmed safety parameters.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A gas valve for an intermittent pilot ignition system, comprising:

a valve housing comprising a first fluid pathway between an upstream inlet port and a downstream outlet port and a second fluid pathway between the upstream inlet port and a downstream pilot port;

a first diaphragm disposed in the first fluid pathway between the upstream inlet port and the downstream outlet port, the first diaphragm being biased in a first closed position;

a second diaphragm disposed in the first fluid pathway between the upstream inlet port and the downstream outlet port, the second diaphragm being biased in a second closed position;

at least one valve disposed in the first fluid pathway or the second fluid pathway, the at least one valve configured to prevent the first diaphragm and the second diaphragm from opening under a negative pressure having an absolute value of at least 26" W.C.

wherein flow of gas through the first fluid pathway from the upstream inlet port to the downstream outlet port requires a positive gas pressure sufficient to open both of the first diaphragm from the first closed position and the second diaphragm from the second closed position.

2. The gas valve of claim 1, wherein the at least one valve comprises two check valves disposed in the second fluid pathway.

3. The gas valve of claim 2, wherein a first check valve of the two check valves is positioned in a first flow passage between a first side of the first diaphragm and a second side of the first diaphragm and wherein a second check valve of the two check valves is positioned in a second flow passage downstream of the first flow passage and proximal to the pilot port.

4. The gas valve of claim 3, wherein the first check valve and the second check valve are both ball valves.

5. The gas valve of claim 1, wherein the at least one valve comprises a relief valve disposed in the first fluid pathway.

6. The gas valve of claim 5, wherein the valve housing further comprises an inlet chamber disposed between the upstream inlet port and the first diaphragm.

7. The gas valve of claim 6, wherein the relief valve comprises a relief port providing a passage from the inlet chamber to an exterior of the valve housing and a spring-biased plunger disposed within a bore of the valve housing, the spring-biased plunger having a stopper head coaxial with the relief port;

wherein, during periods of fuel gas flow, a positive fuel gas pressure within the inlet chamber forces the stopper head against the relief port to block flow through the relief port; and wherein, during periods of inactivity, the negative pressure causes the spring-biased plunger to retract the stopper head from the relief port.

8. The gas valve of claim 1, wherein the first diaphragm and the second diaphragm are prevented from opening under the negative pressure having an absolute value of at least 55" W.C.

9. A gas valve for an intermittent pilot ignition system, comprising:

a valve housing comprising a first fluid pathway between an upstream inlet port and a downstream outlet port and a second fluid pathway between the upstream inlet port and a downstream pilot port;

a first diaphragm disposed in the first fluid pathway between the upstream inlet port and the downstream outlet port, the first diaphragm being biased in a first closed position;

a second diaphragm disposed in the first fluid pathway between the upstream inlet port and the downstream outlet port, the second diaphragm being biased in a second closed position;

a first check valve disposed in the second fluid pathway, the first check valve positioned in a first flow passage between a first side of the first diaphragm and a second side of the first diaphragm; and a second check valve disposed in the second fluid pathway, the second check valve positioned in a second flow passage downstream of the first flow passage and proximal to the pilot port;

wherein the first check valve and the second check valve are configured to prevent the first diaphragm and the second diaphragm from opening under a negative pressure of at least 26" W.C.; and wherein flow of gas through the first fluid pathway from the upstream inlet port to the downstream outlet port requires a positive gas pressure sufficient to open both of the first diaphragm from the first closed position and the second diaphragm from the second closed position.

10. The gas valve of claim 9, wherein the first diaphragm and the second diaphragm are prevented from opening under a negative pressure of at least 55" W.C.

11. The gas valve of claim 9, wherein the first check valve is a ball valve.

12. The gas valve of claim 9, wherein the second check valve is a ball valve.

13. The gas valve of claim 9, wherein a solenoid is disposed between the first flow passage and the second flow passage, the solenoid configured to control a flow of gas between the first flow passage and the second flow passage.

14. The gas valve of claim 9, wherein the first flow passage comprises a bleed valve between the first side of the first diaphragm and the second side of the first diaphragm.

15. The gas valve of claim 14, wherein the bleed valve is downstream of the first check valve.

16. The gas valve of claim 9, wherein the first diaphragm is upstream of the second diaphragm.

* * * * *